US009970569B2

(12) United States Patent
Kotrla et al.

(10) Patent No.: US 9,970,569 B2
(45) Date of Patent: May 15, 2018

(54) CLOSURE MEMBER POSITION INDICATOR SYSTEM FOR USE IN A BLOWOUT PREVENTER

(71) Applicant: Cameron International Corporation, Houston, TX (US)

(72) Inventors: Johnnie Kotrla, Katy, TX (US); Carter Erwin, Houston, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 214 days.

(21) Appl. No.: 14/972,298

(22) Filed: Dec. 17, 2015

(65) Prior Publication Data

US 2017/0175927 A1 Jun. 22, 2017

(51) Int. Cl.

| | |
|---|---|
| ***F16K 37/00*** | (2006.01) |
| ***E21B 33/06*** | (2006.01) |
| ***E21B 33/064*** | (2006.01) |

(52) U.S. Cl.

CPC ..... *F16K 37/0041* (2013.01); *E21B 33/062* (2013.01); *E21B 33/064* (2013.01); *F16K 37/0008* (2013.01); *Y10T 137/8242* (2015.04); *Y10T 137/8275* (2015.04)

(58) Field of Classification Search

CPC ..... F16K 37/0041; F16K 37/0008; E21B 33/064; E21B 33/062; Y10T 137/8242; Y10T 137/8275; Y10T 137/8225

USPC ..... 251/1.1–1.3; 137/553, 554, 556; 166/85.4

See application file for complete search history.

(56) References Cited

U.S. PATENT DOCUMENTS

| | | | | |
|---|---|---|---|---|
| 2,124,015 | A * | 7/1938 | Stone | E21B 33/06 251/1.1 |
| 4,877,217 | A * | 10/1989 | Peil | E21B 34/16 251/1.3 |
| 4,922,423 | A * | 5/1990 | Koomey | E21B 33/063 166/373 |
| 5,320,325 | A * | 6/1994 | Young | E21B 33/062 251/1.3 |
| 5,407,172 | A * | 4/1995 | Young | E21B 33/062 137/554 |
| 6,427,576 | B1 * | 8/2002 | Bock | F15B 15/2807 92/5 R |
| 7,437,988 | B2 * | 10/2008 | Andersson | F15B 15/2892 92/5 R |
| 7,533,865 | B2 | 5/2009 | Whitby et al. | |
| 7,762,338 | B2 * | 7/2010 | Fenton | E21B 33/043 166/250.01 |
| 7,832,706 | B2 * | 11/2010 | Judge | E21B 33/062 166/85.4 |
| 8,413,716 | B2 * | 4/2013 | Judge | E21B 33/062 251/1.3 |
| 8,544,538 | B2 * | 10/2013 | Weir | E21B 33/062 166/85.4 |
| 8,657,253 | B2 * | 2/2014 | Judge | E21B 33/062 251/1.3 |

(Continued)

*Primary Examiner* — John Bastianelli
(74) *Attorney, Agent, or Firm* — Helene Raybaud

(57) ABSTRACT

A system and method for detecting a position of a blowout preventer's closure members makes use of an indicator rod connected to a piston of the operator system and an electronic position sensor located entirely outside of a pressurized chamber of the operator system and arranged to detect a linear movement of the indicator rod.

13 Claims, 5 Drawing Sheets

(56) References Cited

U.S. PATENT DOCUMENTS

| | | | | |
|---|---|---|---|---|
| 2008/0040070 | A1* | 2/2008 | McClanahan | E21B 33/062 702/158 |
| 2010/0152901 | A1* | 6/2010 | Judge | E21B 33/062 251/1.3 |
| 2011/0174503 | A1* | 7/2011 | Elsayed | E21B 17/025 166/385 |
| 2012/0000646 | A1* | 1/2012 | Liotta | E21B 33/062 251/1.3 |
| 2013/0146793 | A1* | 6/2013 | Gustafson | E21B 33/062 251/1.3 |
| 2014/0064029 | A1 | 3/2014 | Jaffrey | |

* cited by examiner

CLOSURE MEMBER POSITION INDICATOR SYSTEM FOR USE IN A BLOWOUT PREVENTER

BACKGROUND OF INVENTION

The invention relates to methods and apparatus for indicating the position of the closure members of a subsea blowout preventer ("BOP").

A BOP is a safety device that closes, isolates, and seals a wellbore to prevent the uncontrolled release of crude oil and/or natural gas from the well. One common type of BOP, a ram-type BOP, uses two opposed closure members, or rams, disposed within a specially designed housing or body having a bore aligned with that of the wellbore. Opposed cavities intersect the bore and support the rams for movement into and out of the bore. A bonnet connected to the body on the outer end of each cavity supports an operator system that provides the force required to move the rams into and out of the bore. The force is usually provided by pressurized hydraulic fluid.

The rams are equipped with sealing members that engage with one another to prohibit flow through the bore when the rams are closed. The rams may be pipe rams, which are configured to close and seal an annulus around a pipe disposed within the bore, or the rams can be blind or shearing rams, which are configured to close and seal the entire bore, and can shear a pipe in the wellbore. A particular drilling application may require a variety of these pipe rams and blind rams assembled as a stack of BOPs.

One issue with ram-type BOPs when used subsea is knowing, with certainty, whether the rams have fully extended once the BOP is activated. "Inside the box" approaches to indicate the position of the rams install electronics directly into the pressurized operating chambers of the BOP and other well control equipment. These installations tend to be complex and the installed electronics can sometimes compromise pressure integrity of the operating chambers.

SUMMARY OF THE INVENTION

A preferred embodiment a system for indicating the position of a closure member of a blowout preventer ("BOP") makes use of an indicator rod that penetrates the pressure chamber of the BOP using well-known shaft sealing technology, and then fixes a non-pressure containing electronic position sensor to the indicator rod. This completely avoids exposing the electronics to the pressure chamber of the blowout preventer or connector.

In one preferred embodiment, the indicator rod is arranged in sliding sealed relationship to the operator system housing of the blowout preventer with one end penetrating a pressurized chamber of the operator system and the other end being located outside of the pressurized chamber. An electronic position sensor, which is located entirely outside of the pressurized chamber, is connected to or positioned relative to the rod to detect a linear movement of the indicator rod.

A method for detecting a position of a BOP's closure members includes the steps of monitoring a linear position of the indicator rod (arranged as above) using the electronic position sensor and inferring the position of the closure member based upon the detected linear movement of the indicator rod.

Objectives of this invention include providing a closure member position indicator that (1) makes use of a mechanical indicator rod sealed relative to the pressurized chamber of the BOP using well known sealing technology; (2) does not use an electronic arrangement that compromises the pressure integrity of the operating chamber; (3) provides for redundant position indication, that is, both visual and electronic; (4) can use less costly non-pressure containing sensor than the pressure containing sensors that must be used inside the operator system; and (5) can be easily retrofitted for use with existing BOP designs.

ELEMENTS AND NUMBERING USED IN THE DRAWINGS AND DETAILED DESCRIPTION

Figure 1:
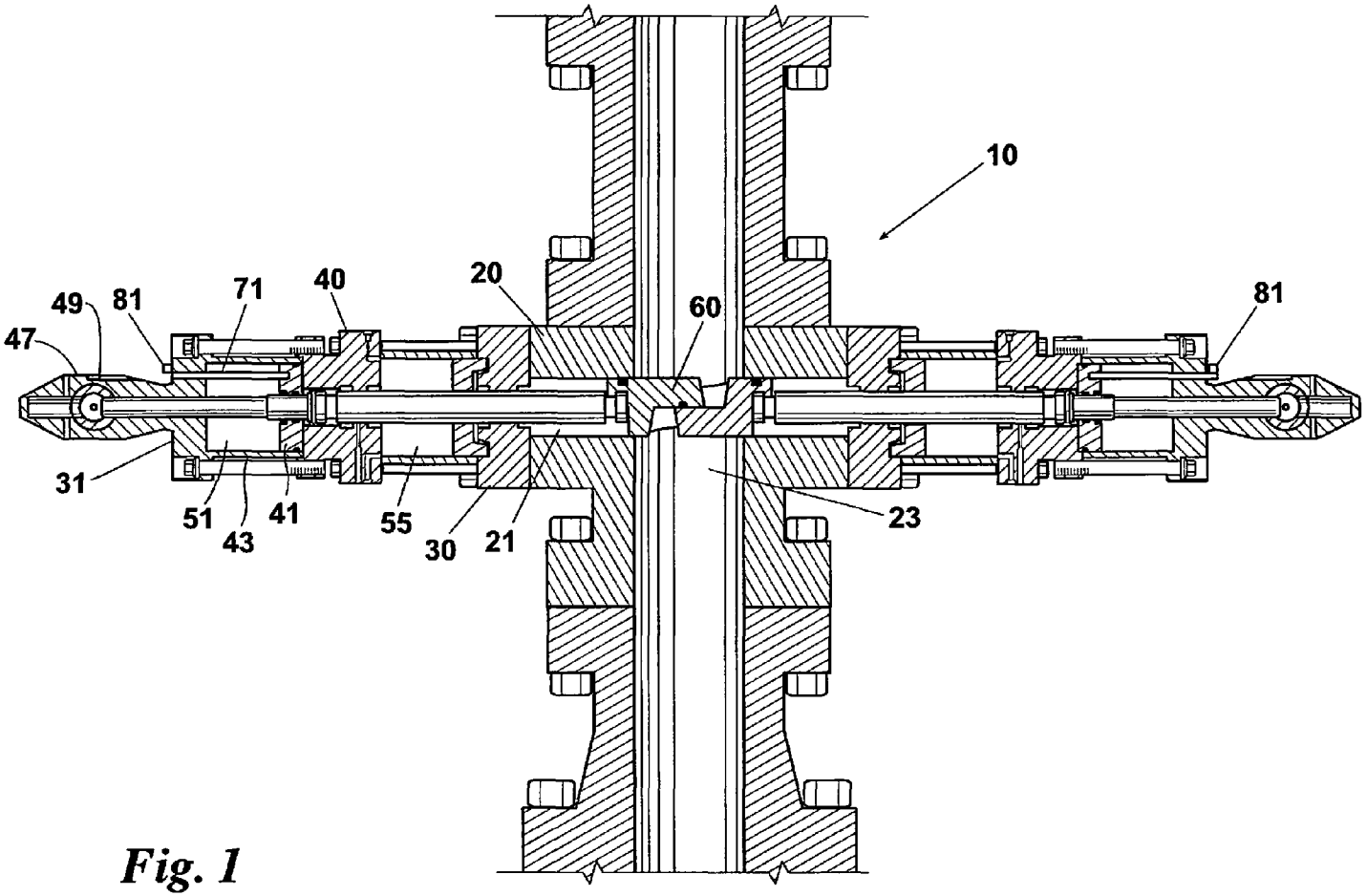
FIG. 1 is a cross-sectional view of an hydraulic operator of a ram-type blowout preventer ("BOP") when in the extended (closed) position. The position of each closure member is indicated by a rod having one end located within a pressure chamber of the operator system housing and connected to the closure member and the other end located outside the bonnet flange plate. An electronic sensor mounted on or within the rod, or outside the bonnet flange plate or operator housing, detects any movement of the rod and reports the rod's position.
Figure 2:
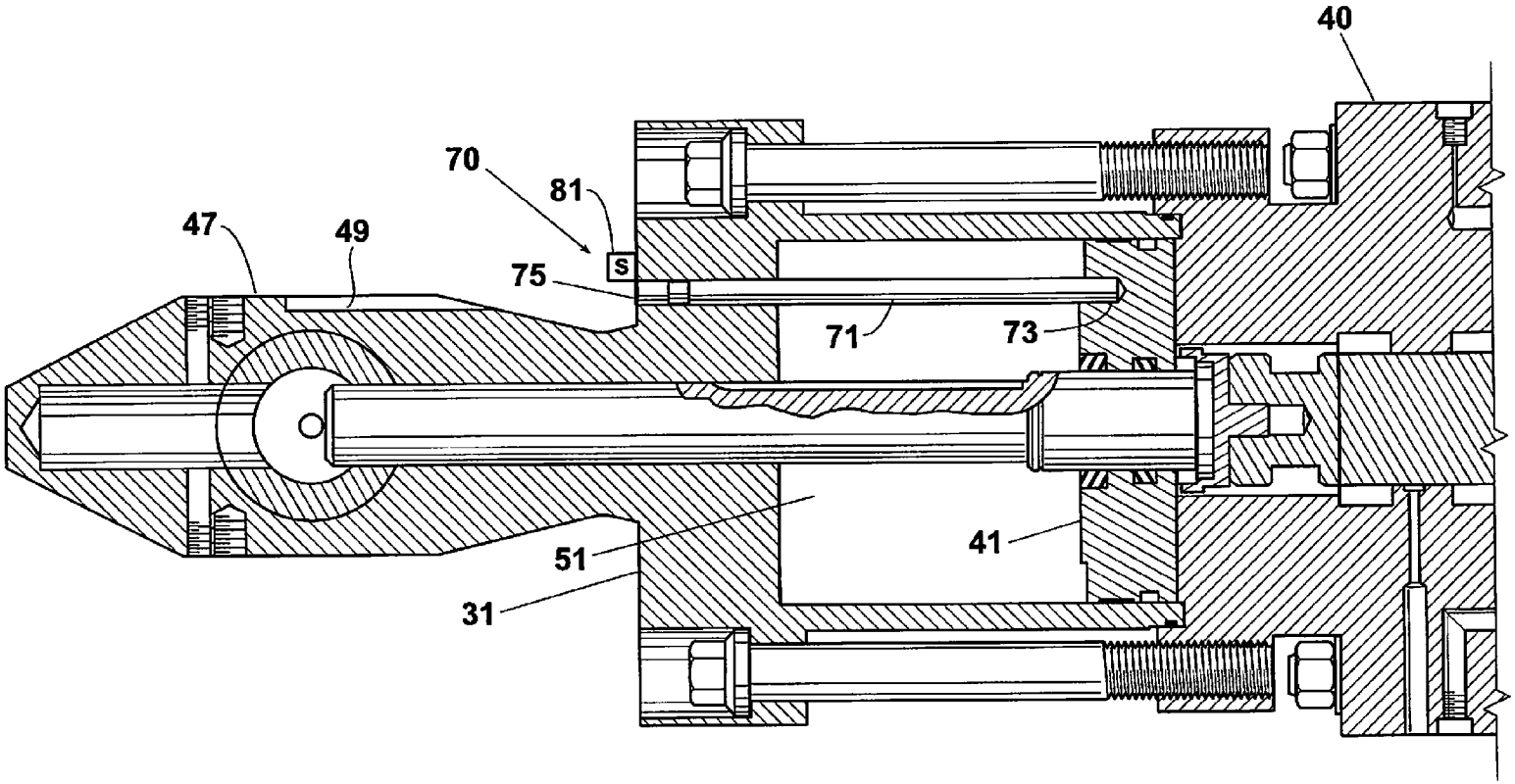
FIG. 2 is a detailed cross-sectional view of the hydraulic operator of FIG. 1.
Figure 3:
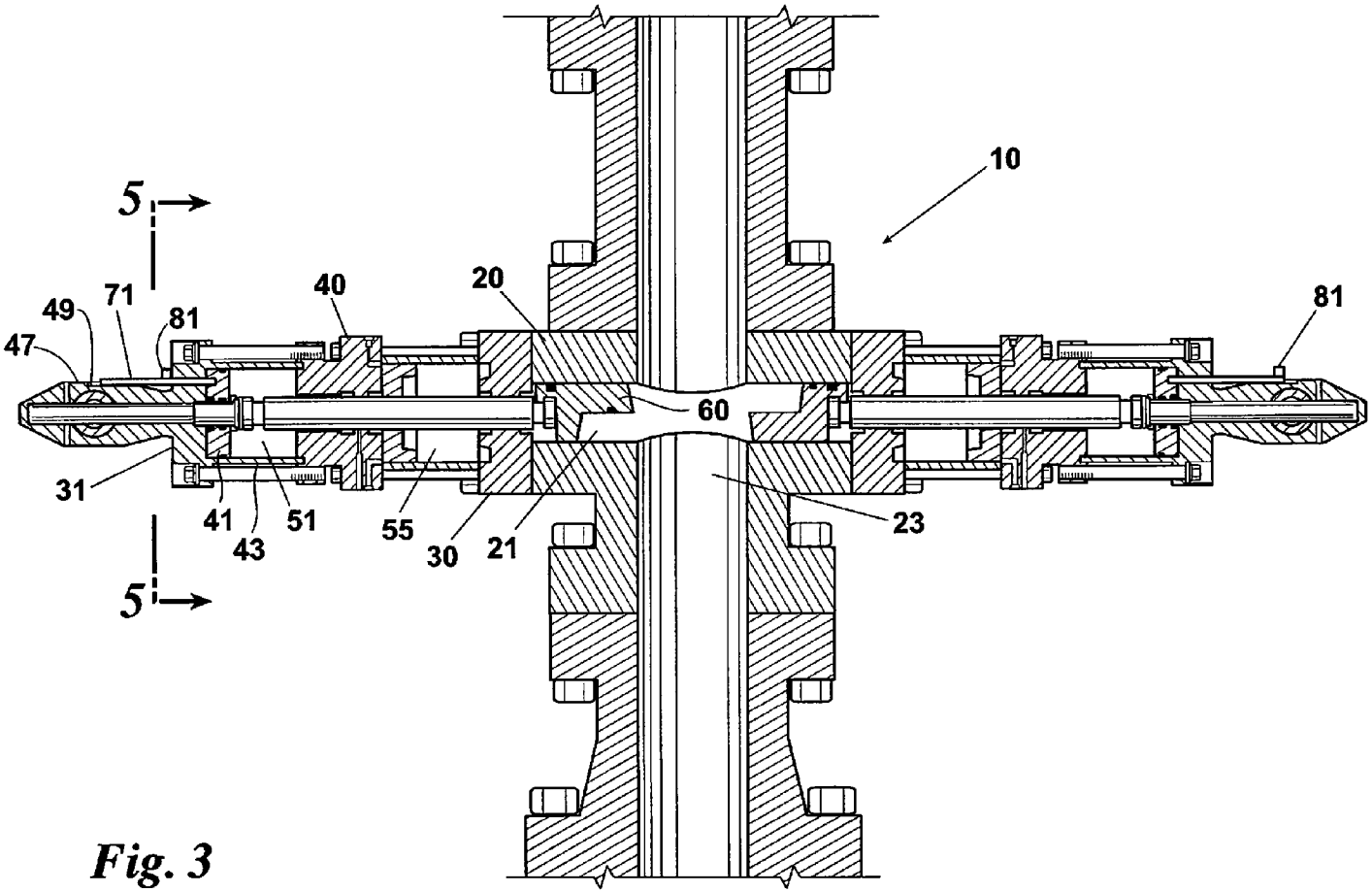
FIG. 3 is a cross-sectional view of the hydraulic operator of FIG. 1 in a retracted (open) position.
Figure 4:
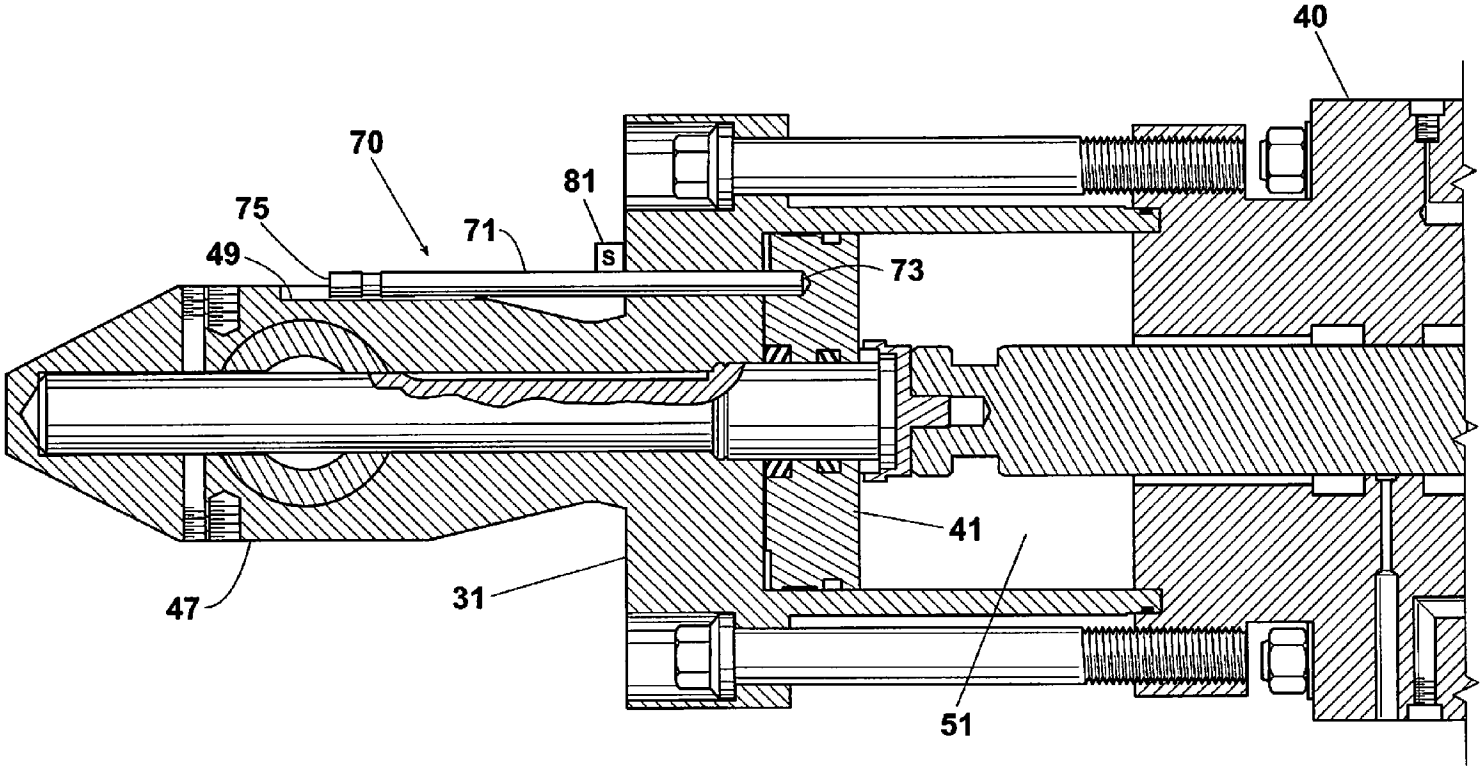
FIG. 4 is a detailed cross-sectional view of the hydraulic operator of FIG. 3. The exposed rod end can ride in a clearance groove machined into the top of the lock housing (see also FIG. 2).
Figure 5:
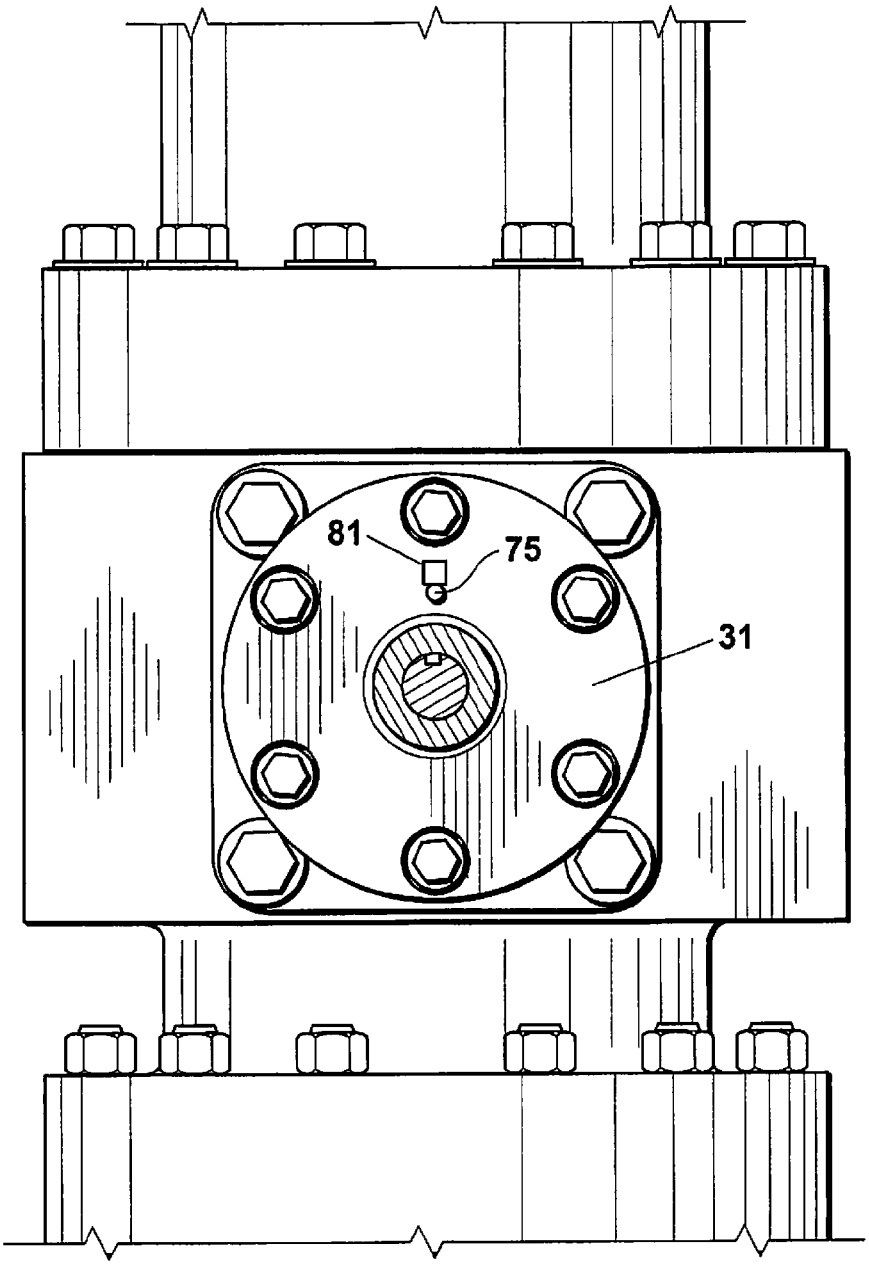
FIG. 5 is an end view of the hydraulic operator taken along section line 5-5 of FIG. 3. One end of the indicator rod is located outside of the bonnet flange plate.

10 Blowout preventer ("BOP")
20 Body
21 Cavities
23 Bore
30 Bonnet
31 Bonnet flange
40 Operator system
41 Hydraulic piston
43 Cylinder
47 Lock housing or operator housing
49 Clearance groove
51 Close chamber
53 Slack chamber (which may or not be required)
55 Open chamber
55 Closure member
60 Closure member position-indicator system
70 Indicator rod
71 First end (connected to 45)
75 Second end (exposed end)
81 Electronic position sensor

DETAILED DESCRIPTION OF THE PREFERRED EMBODIMENTS

The preferred embodiments described below provide examples of a closure member position indicator system and method of its use, made according to this invention.

The system preferably includes both a visual and an electronic indication of the closure member's position as the closure member moves between a fully retracted and fully extended position. The electronic indication is accomplished without any electronic penetration of a pressure chamber of the blowout preventer ("BOP").

Referring now to the drawing figures, a ram-type BOP 10 includes a body 20 having cavities 21 and a bore 23, bonnets 30 connected to the body 20, and operator systems 40 mounted to the bonnets 30. The operator systems 40 use an hydraulic piston 41 and cylinder 43 arrangement to move a respective closure member 60 through cavities 21 and into and out of bore 23.

Typically, the operator systems 40 include three hydraulically isolated pressure chambers, a close chamber 51, an optional slack fluid chamber 53, and an open chamber 55. In general, the extend and retract chambers 51, 55 are in fluid communication with an hydraulic fluid supply regulated by a control system. Slack fluid chamber 53 may be pressure balanced with the surrounding environment, left open to the surrounding environment, coupled to a pressure compensation system that maintains the balanced pressure within the chamber 53, or connected to a control system.

Additional details on the construction and operation of a ram-type BOP and BOP stack can be found, for example, in U.S. Pat. No. 7,533,865 B2 to Whitby et al. and US 2014/0064029 A1 to Jaffrey ("Jaffrey"), both hereby incorporated by reference.

A closure member position indicator system 70 provides a visual indication of the position of piston 41—and, therefore, the position of the closure member 60—as well as an electronic indication of the piston's 41 position without electronic penetration of any of the pressure chambers 51, 53, 55. When piston 41 is in a fully open position, the closure members 60 are ready to deploy. When piston 41 is in a fully closed position, the closure members 60 have been fully deployed.

Visual indication of the piston's 41 position is provided by an indicator rod 71 arranged in a sliding sealed relationship to the operator system housing 47. In a preferred embodiment, the rod 71 is sealed relative to the bonnet flange 31 using sealing means well-known in the art and can ride, if desired, in a clearance groove 49 of the lock or operator housing 47 (depending on its configuration). One end 73 of the indicator rod 71 is connected to the piston 41 (and therefore resides entirely within a pressurized chamber 51, 53, 55 of housing 47) and the other end 75 is located outside of the housing 47.

An electronic position or position measuring sensor 81 is also located outside of the lock or operator housing 47 and positioned relative to the indicator rod 71 to detect a linear movement of the indicator rod 71. Preferably, the sensor 81 is mounted or connected to the rod 71. The sensor 81 can be in communication with, and a part of, a subsea electronic information system like that disclosed by Jaffrey (referenced earlier).

Jaffrey's system includes a subsea-located sensor interface box that includes a processor and a memory device capable of receiving and storing sensor measurement data like that provided by electronic position sensor 81. Additionally, the sensor interface box is in data and power communication with the sensor 81. A subsea retrievable data capsule may be used in connection with the box and recovered from subsea (independently of the other elements of the information system) for forensic analysis of the recorded data.

The indicator rod 71, seal assembly, and sensor 81 can be removed and replaced with a blanking cap (not shown) in order to return to conventional operations and position monitoring.

A method for detecting a position of the closure members 60 includes the steps of monitoring a linear position of the indicator rod 71 using the electronic position sensor 81 and then inferring a position of the closure members 60 based upon a visually detected linear movement of the indicator rod 71. The method can also include the steps of removing the rod 71, seal assembly, and sensor 81 and installing a blanking cap.

What is claimed:

1. A method for detecting a position of a closure member of a blowout preventer, the method comprising the step of:

monitoring a linear position of an indicator rod having a first end in communication with the closure member housed by the operator system and a second end located outside of an operator system housing of the blowout preventer and another, the monitoring step being performed by an electronic position sensor arranged to detect a linear movement of the indicator rod; and inferring a position of the closure member based upon the detected linear movement of the indicator rod;

wherein the second end of the indicator rod is extended farthest out of the operator system housing when the closure member is in a ready-to-deploy position and least extended out of the operator system housing when the closure member is in a fully deployed closed position.

2. A method according to claim 1 wherein the detected linear movement is visually detected.

3. A method according to claim 1 wherein the electronic position sensor is located entirely outside of a pressurized chamber the blowout preventer.

4. A method according to claim 1 wherein the electronic position sensor is located on the indicator rod.

5. A method according to claim 1 wherein the first end of the indicator rod is connected to a piston of an operator system for the closure member.

6. A method according to claim 1 wherein a portion of the indicator rod is received by a clearance groove of the operator system housing.

7. A method for detecting a position of a closure member of a blowout preventer, the method comprising the step of:

monitoring a linear position of an indicator rod having a first end in communication with the closure member, the monitoring step being performed by an electronic interface arranged entirely outside of a pressurized chamber of the blowout preventer to visually detect a linear movement of the indicator rod; and inferring a position of the closure member based upon the visually detected linear movement of the indicator rod;

a second end of the indicator rod located outside of the operator system housing being in a fully extended position when the closure member is in a ready-to-deploy position and in a fully retracted position when the closure member is in a fully deployed closed position.

8. A blowout preventer comprising:

an indicator rod arranged in sliding sealed relationship to an operator system housing of the blowout preventer, a first end of the indicator rod being in communication with a closure member housed by the operator system housing, a second end of the indicator rod being located outside of the operator system housing;

the second end of the indicator rod being extended farthest out of the operator system housing when the closure member is in a ready-to-deploy position and least extended out of the operator system housing when the closure member is in a fully deployed closed position; and an electronic position sensor positioned relative to the second end of the indicator rod to detect a linear movement of the indicator rod.

9. A blowout preventer according to claim 8 wherein the electronic position sensor is located entirely outside of a pressurized chamber of the blowout preventer.

10. A blowout preventer according to claim 8 wherein the electronic position sensor is located on the indicator rod.

11. A blowout preventer according to claim 8 wherein the first end of the indicator rod is connected to a piston of an operator system for the closure member.

12. A blowout preventer according to claim 8 further comprising a clearance groove in the operator system housing, the clearance groove being arranged to receive a portion of the indicator rod.

13. A blowout preventer comprising:

an indicator rod having a first end in communication with a closure member housed by an operator system housing of the blowout preventer; and an electronic position sensor positioned relative to a second end of the indicator rod to detect a linear movement of the indicator rod, the electronic position sensor being located entirely outside of a pressurized chamber of the blowout preventer;

a second end of the indicator rod located outside of the operator system housing being extended farthest out of the operator system housing when the closure member is in a ready-to-deploy position and least extended out of the operator system housing when the closure member is in a fully deployed closed position.

* * * * *